United States Patent [19]

Hartman

[11] 4,155,202

[45] May 22, 1979

[54] TELESCOPING SEATING SYSTEM WITH AUTOMATICALLY FOLDING CHAIRS

[75] Inventor: Arlin P. Hartman, Champaign, Ill.

[73] Assignee: American Seating Company, Grand Rapids, Mich.

[21] Appl. No.: 897,941

[22] Filed: Apr. 3, 1978

[51] Int. Cl.[2] ..... E04H 3/12

[52] U.S. Cl. ..... 52/9

[58] Field of Search ..... 52/9, 10, 8; 297/236, 297/250, 232, 35

[56] References Cited

U.S. PATENT DOCUMENTS

| | | | |
|---|---|---|---|
| 3,443,835 | 5/1969 | Brunskole | 297/35 |
| 3,464,753 | 9/1969 | Van Ryn | 297/232 |
| 4,063,392 | 12/1977 | Van Ryn et al. | 52/9 |

*Primary Examiner*—John E. Murtagh

*Attorney, Agent, or Firm*—Emrich, Root, O'Keefe & Lee

[57] ABSTRACT

In a telescoping seating system having a number of rows which may be moved between an extended or use position and a retracted or storage position, chairs or other seating is mounted on stanchions which are pivotally mounted to the rear of the deck in each row. The stanchions are pivoted to an upright position when the system is extended for use and folded to a horizontal position when the system is retracted for storage by means of an actuator mechanism mounted to the forward portion of the next higher row and operative in response to relative movement between adjacent rows. In this manner, the height of the seats is independent of the rise of the system for more comfortable seating. A torsion rod assembly is mounted beneath the seating to counterbalance at least some of the weight of the seating in the storage position. Locking members engage the stanchions in the use position to secure the seating in the raised position. The locking members are released in response to the closing motion between adjacent rows to permit the seating to be folded to the storage position in the space between adjacent decks.

28 Claims, 17 Drawing Figures

160
163
176
163
153
140
149
143
120
112
123

TELESCOPING SEATING SYSTEM WITH AUTOMATICALLY FOLDING CHAIRS

FIELD OF THE INVENTION

The present invention relates to telescoping seating systems of the type which may be moved between an extended or use position in which the rows are in stepped or tiered relation, and a retracted or storage position in which the rows are aligned vertically.

The present invention is particularly directed to a telescoping seating system which is provided with individual chairs which may be arranged in groups and which are automatically folded onto the deck when the system is retracted for storage, and automatically raised for use when the system is extended.

SUMMARY OF THE INVENTION

In a preferred embodiment for operation in a fully automatic mode, the seating is provided in individual chairs arranged in groups of two to seven or more chairs. The seating is mounted on stanchions which are pivotally mounted to the rear of a deck for each row. The stanchions which carry the seats and backs are pivoted to an upright position when the system is extended for use, and folded to a horizontal position when the system is retracted for storage. This is accomplished, in part, by means of an actuator mechanism which is mounted to the forward portion (called the "nose") of the next higher row. When the rows are extended, the actuator engages a surface, slot or notch on an associated stanchion to pivot the stanchion to an upright position as the rows are moved apart. A torsion rod assembly, preferably mounted beneath the seating on the top of the deck and to the rear of the deck, is used to counterbalance at least some of the weight of the seating in the storage position. Thus, the torsion rod assists in the raising of the seats to enable leverage action between adjacent rows to raise the seating. This is considered an important and novel aspect of the invention when it is appreciated that the amount of leverage is limited by the rise (that is, the vertical distance between the same point on adjacent rows), yet according to the present invention, both the seats and the backs are raised above the deck of the next higher row. Thus, with the present invention, the height of the seat is not limited by the rise of the rows. This has a number of advantages. It enables much more comfortable seating because the feet of the occupant rest on the same platform as the chair is mounted, and the seat of the chair may be located at a normal height above that platform. Further, it permits an architect to improve the line of sight for occupants of the higher rows by increasing the rise for the higher rows.

A locking member or leg brace cooperates with each stanchion for locking the stanchion in its upright position when that particular row is fully opened. Closing motion of a row unlocks the locking members before the seating is positioned in the storage position as the row closes. During closing, the actuators on the nose of the next higher row engage the stanchions to lower the seating.

The torsion rod mechanism is mounted beneath the seating on top of and toward the rear of each deck. A cover plate encloses and hides the mechanism from view and this, together with the fact that the mechanism is mounted to the rear of the deck and out of the way, faclitates maintenance and cleaning.

It is also considered an important aspect of the present invention, both from the view point of original manufacture as well as for retro-fitting existing systems, that all of the apparatus for automatically raising and lowering the chairs be mounted to the upper side of a deck, rather than beneath or behind the deck where it is not only more difficult to install and maintain, but where the possibility of interfering with the deck support and actuating systems is greater.

Another advantage of the present invention is that the seating is folded and unfolded only in response to the relative movement between adjacent rows. This is important because special sequencing of the rows is not required in moving the system between the storage position and the use position. In operation, when a lower row is extended relative to the next higher row, the actuator mounted on the forward portion of the next higher row engages and rotates the stanchions upwardly. The weight of the seating is at least partially counterbalanced by the torsion rods so that the initial force required to raise the seating is not great.

As the stanchions are rotated to a fully raised position, the lock members are also rotated into locking arrangement with the stanchions to secure them in the raised position.

The folding of the seating for storage is also independent of any particular sequence of row closing or retraction, and responsive only to the relative movement of two adjacent (i.e. higher and lower) rows. When a lower row carrying the seating is retracted, the forward portion of the deck of the next higher row urges the locking members slightly forwardly to disengage them from locking positions with the stanchions. After the locking members are unlocked, the nose of the next higher row urges the stanchions to rotate forwardly about their pivotal mountings so that the seating is folded in the space between adjacent decks. During lowering of the seating, the torsion bar apparatus continues to counterbalance the weight of the seating, and the remainder of the weight is borne by the actuator mechanisms on the nose of the deck of the next higher row. In storage, the seating fits without protrusion between the decks of adjacent rows.

The apparatus of the present invention may be used for various types of seating, such as benches; and it may be adapted to incorporate various chair designs. However, it is preferred to use chairs mounted on beams in groups of two to seven.

Other features and advantages of the present invention will be apparent to persons skilled in the art from the following detailed description of alternative embodiments, accompanied by the attached drawing wherein identical reference numerals will refer to like parts in the various view.

THE DRAWING

DETAILED DESCRIPTION

Figure 1:
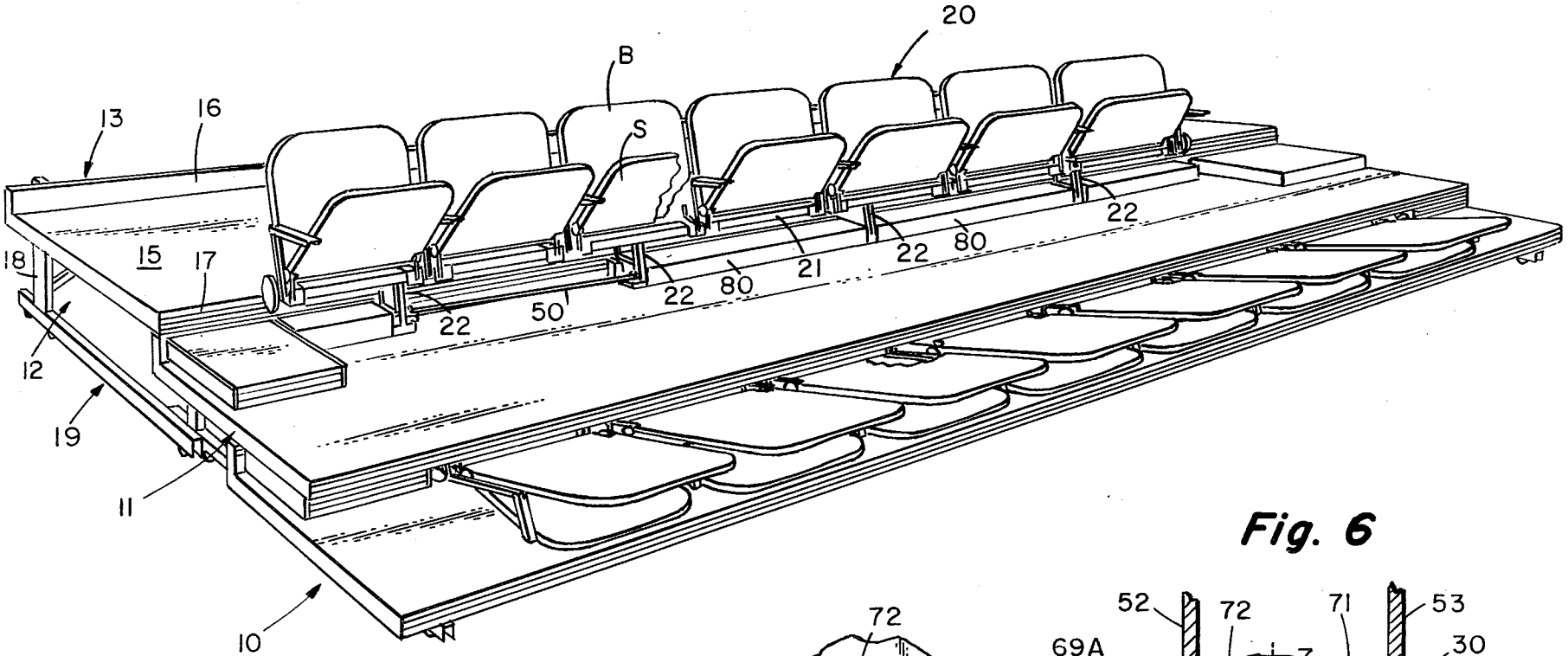
FIG. 1 is an upper front perspective view showing the two bottom rows of a telescoping seating system incorporating the present invention.

Referring first to FIG. 1, three lower rows of a telescoping seating system having a plurality of rows are shown. These rows are generally designated 10, 11 and 12 respectively. When the system is extended to the use position (see row 11 relative to row 12), the rows are in stepped or tiered relation. When the system is retracted for storage, the rows are generally vertically aligned.

Each of the rows is similar in structure, so that only one row structure need be described for an understanding of the structure of each row. Referring to the row 12, it includes a deck generally designated 13 which includes a forwardly extending horizontal platform 15 and a rear riser 16.

The forward portion of the platform 15 is referred to as the "nose", and it is designated by reference numeral 17. The rear riser 16 may be a metal beam, as is known in this art, mounted between two upright posts, one of which is shown at 18 in FIG. 1. Support arms (not seen) extend outwardly from the posts 18 and from the riser beam 13 to support the platform 15. The posts are mounted on wheel carriages, one of which is shown at 19 in FIG. 1. In a system of this type, the lowest row need not have its deck cantilevered — that is, the forward ends of the bottom deck or platform may be supported because it is not necessary that it be open to receive another row beneath it. Further, the wheel carriages for the upper rows are spread increasingly further apart so that the wheel carriages of lower rows nest between them in side-by-side relation when the rows are closed. Additional details of row structure, including the apparatus for supporting a deck while permitting it to be moved between the extended and retracted positions may be found in U.S. Pat. No. 3,667,171, June 6, 1972 or U.S. Pat. No. 4,041,655, Aug. 16, 1977.

The present invention is directed to apparatus for automatically folding chairs or seating into the space between adjacent decks when the seating system is retracted, and for unfolding the seating when the system is extended for use. Advantageously, the present invention may be used with many different types of row structures, as persons skilled in the art will appreciate; and it is not necessary to further describe the row understructure for a full appreciation of the invention.

As seen in FIG. 1, a group of seven chairs generally designated 20 is mounted to the deck 11 as a single group. Groups of lesser number may be used. Further, different types of seating or different chairs than those shown may likewise be used. In the illustrated embodiment, however, which is referred to as a chair platform, individual chairs, each having a back B and a seat S are mounted to a common beam 21. The present invention is not concerned with the manner in which the backs and seats are mounted to the beam 21. Rather, the invention is directed to raising and lowering the group of chairs 20 as a unit, or a number of units, in response to the relative motion of adjacent rows.

Figure 2:
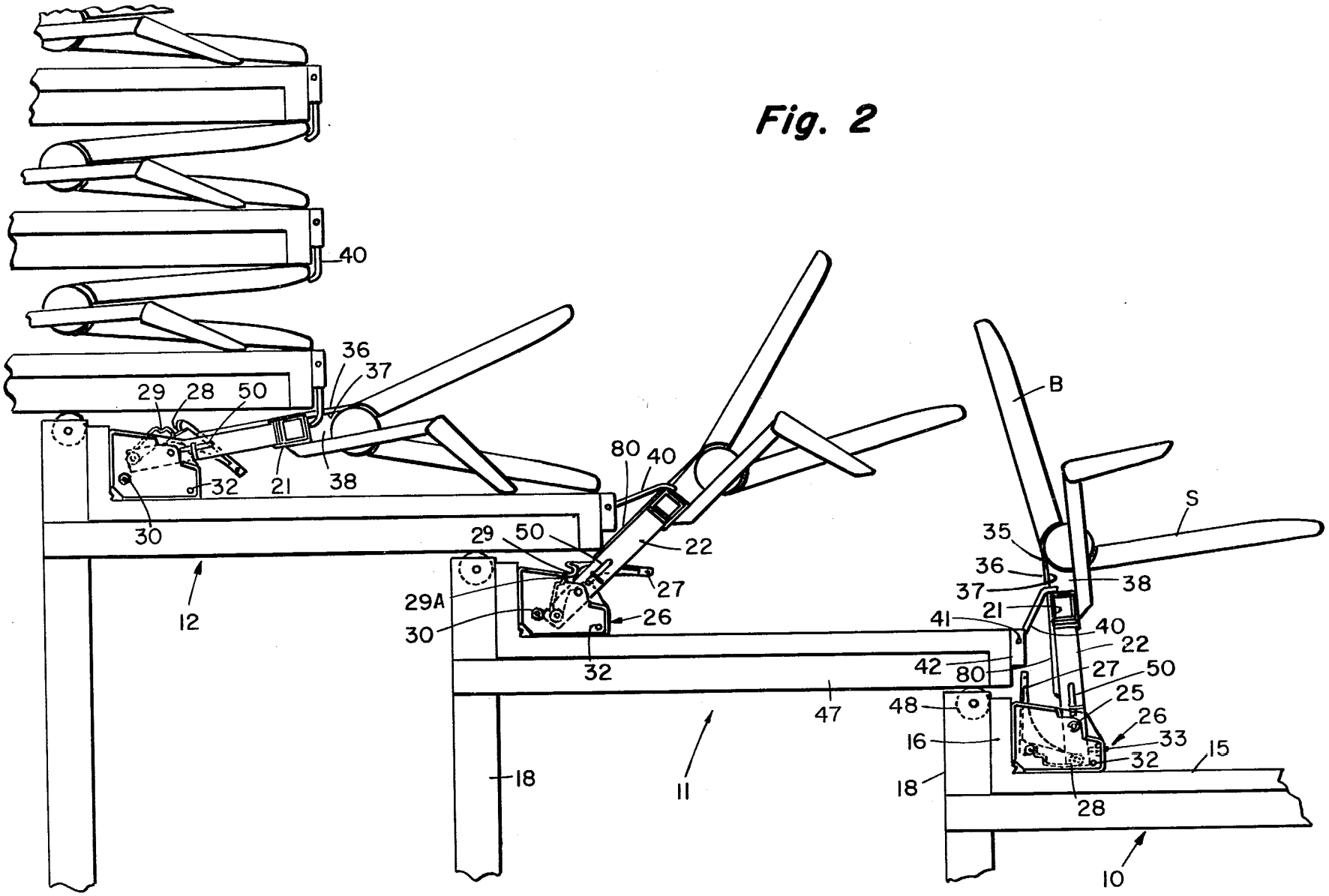
FIG. 2 is a fragmentary side view of the system of FIG. 1 showing adjacent rows in the storage and use positions, as well as in intermediate positions illustrating the opening and closing sequence.

The beam 21 is supported by a number of stanchions — four stanchions being shown in the illustrated embodiment and designated 22. As will be described presently, the stanchions 22 are pivotally mounted at their lower ends to the platform portion of the deck 11. Thus, the beam 21 and stanchions 22 are rotated as a unitary structure to the upright position shown for the row 11 when the row 11 is extended relative to the next higher row 12. Since the sequence for closing is just the opposite to that for opening, when a lower row is retracted beneath the next higher row, the beam 21 and stanchions 22 are rotated forwardly so that the stanchions, beam, backs and seats can be stored in the space between adjacent decks. This is illustrated in FIG. 1 by the position of the chairs in the row 10. Referring now to FIG. 2, each of the chair groupings for the different rows is similar in structure, as are the rows themselves; so that similar reference numerals will be used to refer to like parts for the different rows. Referring then to the right side of FIG. 2, the stanchion 22 is pivotally mounted on a pin 25 to a housing generally designated 26. A locking member 27 is pivotally mounted at 28 to the bottom of the stanchion 22. The heel of the locking member 27 is formed into a first recess 29 and a second partial recess 29A. This is best illustrated for the locking members associated with the higher rows 11 and 12 since, in these positions, the locking members are in a released or unlocked position. In the locked position, the recess 29 snugly engages a pin 30 which is also secured to the stanchion housing 26. The forward bearing surfaces of both recesses 29 and 29A are ground on radii centered at the axis of pin 28 to insure that the locking member will not be dislodged by an occupant of the seat. At the forward end of the housing 26, there is fixed a stop pin 32, and a set screw 33 which is received in a threaded nut or plate welded to the inner surface of the front of the housing 26 (see FIG. 4).

In the illustrated embodiment, the chair comprising the back B and pivotal seat S is secured to the beam 21 by means of a mounting bracket generally designated 35 which includes a laterally extending plate 36 having a forward surface 37. There is a open space forward of the plate 37, and it is designated 38. This space is open and clear above the beam 21 so as to receive an inwardly turned hook portion of a latching member 40 which is pivotally mounted at 41 to a bracket 42 secured to the nose of the deck of the next higher row.

As is known in the art, the forward portion of each deck rests on and is supported by the rear portion of the next lower row. In this embodiment, a cantilever arm 47 for the row 11 extends forwardly of its associated post 18 and rests on a roller 48 mounted to the post 18 for the next lower row 10. This positions the forward portion of the deck in the use position, and it can be seen to be aligned with the uppermost portion of the locking member 27 of the next lower row (referring to the right hand portion of FIG. 2) so as to engage and unlock that member when the two adjacent rows are moved relative to each other to the storage position.

A torsion rod 50 is secured to each stanchion 22, and it extends laterally thereof and is fixed to the housing 26 associated with the next adjacent stanchion. The detailed structure of the torsion rod and housing, as well as that for the adjustable latch member 30 will be described presently. However, it will be understood that the torsion rod 50 acts as an energy storing means such that when the chair is lowered, the torsion rod 50 is twisted clockwise (when viewed from the left), as illustrated in the sequence of positions of the end of the torsion rod 50 in rows 10, 11 and 12 in FIG. 2. Thus, in the storage position, the torsion rod 50 acts to at least partially offset the weight of the chair, the beam 21 and the stanchions 22.

Figure 5:
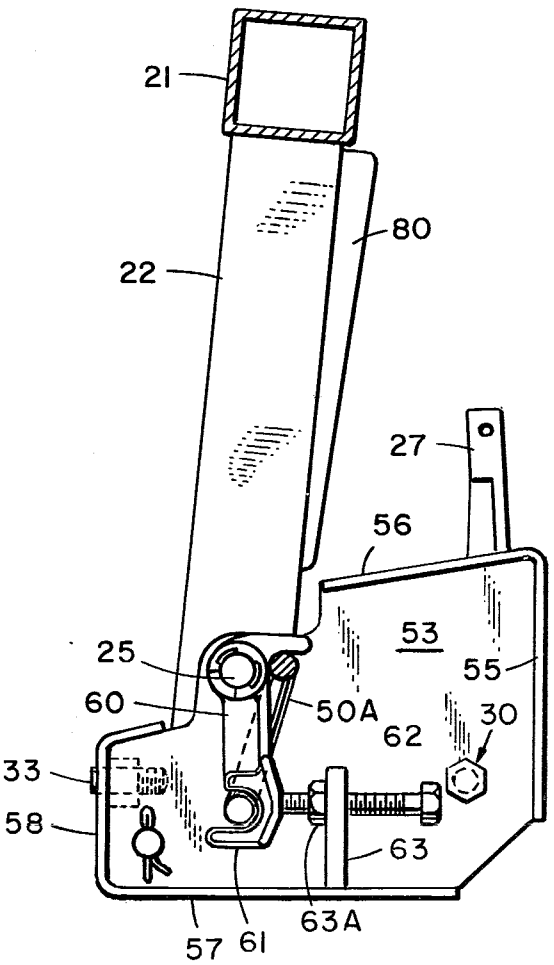
FIGS. 4 and 5 are left and right side views respectively of the apparatus of FIG. 3.
Figure 3:
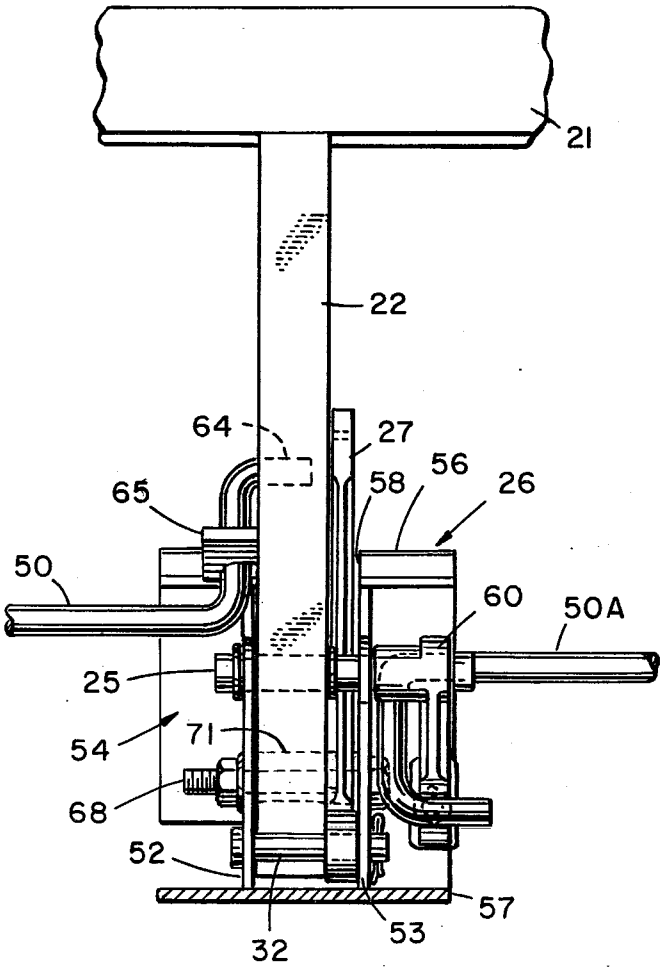
FIG. 3 is a fragmentary front view of the lower portion of a stanchion in the raised position, for the embodiment of FIG. 1.
Figure 4:
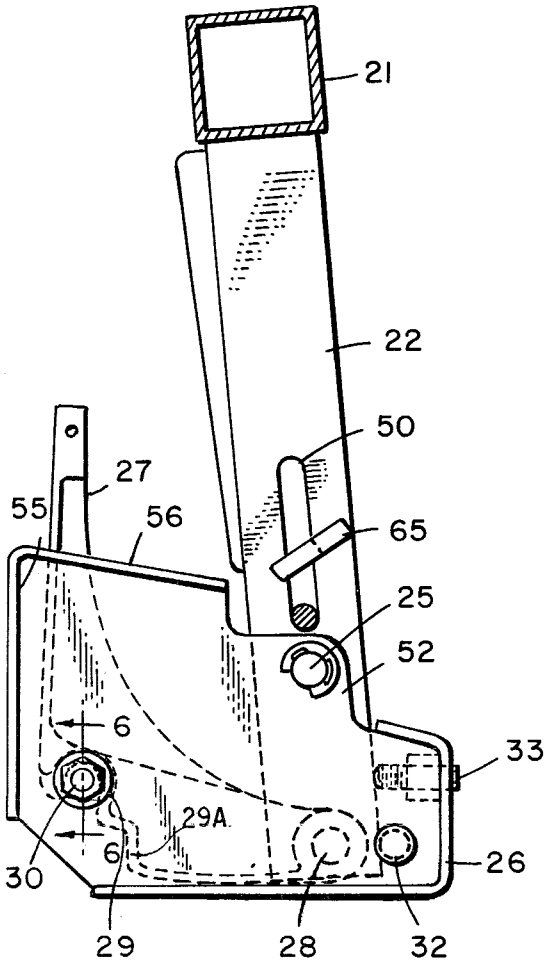

Turning now to FIGS. 3–5, the housing 26 includes first and second side plates 52, 53 which are secured together by an upper flange member 54 providing a back 55 and a top 56, and a lower flange member providing a bottom 57 and a front 58. The back wall 55 may be secured to the rear riser of a deck, and the bottom wall 57 may be secured to the platform.

As best seen in FIG. 3, the top portion 56 defines a slot 58 to permit the locking member 27 to assume the locked position shown in FIG. 5.

The previously described pin 25 and stop member 32 are conventionally mounted to the side plates 52, 53. It will be observed from FIG. 3 that the side plates are spaced apart sufficient to permit both the stanchion 22 and the lock member 27 to be placed between them.

The right end of the pin 25 extends beyond the side plate 53 (again, best seen in FIG. 3) and a casting 60 is pivotally mounted thereto, held by an E-ring. Referring to FIG. 5, the casting 60 extends downwardly and defines a cradle portion 61 which receives and secures the turned portion of a torsion rod 50A. The torsion rod 50A is used to store energy to raise the stanchion to the right of that shown in FIG. 3. The back of the cradle 60 is flanged and limited in rearward motion by means of a bolt 62 threadedly received in a plate 63 welded to the bottom 57 of the housing 26, and locked by a nut 63A. Turning the bolt 62 permits adjustment of the torsion in the torsion rod 50A in the storage position.

Figure 6:
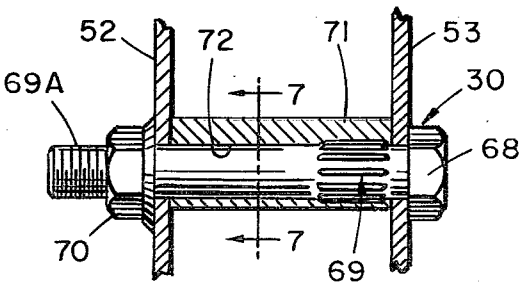
FIG. 6 is a fragmentary, close-up cross sectional view of an adjustable latch for the locking member for the embodiment of FIG. 1, taken through the sight line 6—6 of of FIG. 4.
Figure 7:
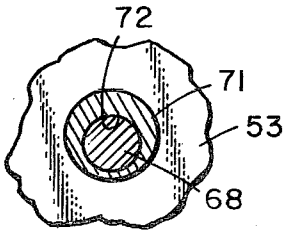
FIG. 7 is a fragmentary, close-up, transverse cross sectional view taken through the sight line 7—7 of FIG. 6.

Referring now to FIG. 3, the right end of the torsion rod 50 is turned and placed in an aperture illustrated by the dash line 64 in the stanchion 22; and a bracket 65 welded to the stanchion 22 also acts to secure the right end of each torsion rod. Referring now to FIGS. 6 and 7, the latch 30 includes a hex head bolt 68 which has a splined shaft 69 and a threaded end 69A which receives a nut 70. A smooth sleeve 71 having an eccentric bore 72 is received over the splined portion 69 of the bolt 68, located between the side plates 52, 53 of the housing 26. The splines 69 prevent rotation of the sleeve 71; and the eccentricity of the bore 72 permits adjustment of the location of the latching member relative to the cavity 28 on the locking member 27 simply by rotating the bolt 68. Once the adjustment is made, the nut 70 is tightened on the bolt 68 so that the sleeve 71 is frictionally held by the side plates 52, 53 of the housing 26. This adjustment achieves a snug fit of the locking member and is used to compensate for any "warp" (i.e. lateral misalignment) of the stanchions. Set screw 33 is tightened to engage the stanchion 22 and take any "play" out of the structure in the raised, locked position that may be caused by manufacturing tolerances in the pivotal connections at pins 25 and 28 and 30 (see FIG. 4). Such tolerances are desirable for this type of structure in the opening and closing movements of the rows — particularly the higher rows which are not as rigid as the lower rows. The weight of the chairs, frame and occupants take out the vertical play. Thus, the adjustable member 33 is operative only in the locked or open position of each stanchion to reduce horizontal play that would otherwise be present, and which is even desirable during opening and closing movements.

OPERATION

Referring back to FIG. 2, when the rows are closed, the actuator element 40 is located in a generally downward position, and extends beneath its associated platform. When the next lower row (referring to row 12) is approximately half open, the actuator member 40 is received in the space 38 with the inwardly turned portion of the actuator 40 beneath the surface 37 of the transverse plate 36. When the actuator member is engaged by the beam 21 (which in this case defines the bottom of the slot 38 and limits the actuator so that the actuator is guided against the rear or lifting surface 37), it rides forwardly until it engages the surface 37, and thereafter, in cooperation with the torsion rods, lifts the chairs, beam and stanchions in progressive fashion as the row continues to be extended (see row 11). The stanchions rotate about the pins 25. As the lower end of the stanchion is moved counterclockwise during opening, the center of gravity of the locking member 27 is moved rearward until it becomes over center relative to the axis of its mounting pin 28. As opening motion continues, the locking member eventually falls in a snapping action and engages the sleeve 71 of the latching member 30. This normally occurs as the forward surface of the lower end of the stanchion 22 engages the stop member 32 or play compensation means 33. However, even if the locking member falls sooner in the motion, the surface 29A will act as a safety stop.

In reversing the sequence for closing the rows, it will be observed that the space 38 permits the actuator 40 to ride forwardly during the initial relative motion between two adjacent rows — at least until the nose of the upper row engages and unlocks the locking member 27. The continued relative closing motion forces the locking member clockwise about the pin 28, and in a short distance, the nose then engages the rear of the stachion 22 (which may be provided with a bearing member 80) so that the continued closing motion forces the seating forwardly and downwardly for storage between adjacent decks, as best seen at the upper left hand portion of FIG. 2. The forward motion of the latching member is limited by pin 25.

The chairs illustrated are of a type referred to as a three-quarters rise chair in which the seat is biased to a three-quarters rise position. The seat is lowered when an occupant sits on it, and it may be raised still further if an occupant rises and steps rearwardly, urging the bottom of the seat towards the back with the rear of his thighs, to permit ingress and egress to other chairs in the row. This further assists in folding the chairs to the storage position.

Referring back to FIG. 1, cover panels 80 are mounted to the lateral flanges provided by the top wall 56 and forward wall 58 of the housings 26.

ALTERNATIVE EMBODIMENT

Referring now to FIGS. 8–17, an alternative embodiment includes a chair couplet generally designated 118 mounted to the top of the lower deck 112. As with the first embodiment, when the lower row 110 telescopes beneath the upper row the seating 118 will fold downwardly into the space between the lower deck 112 and the next higher deck 120 of the upper row. Similarly when the rows are extended for use, the seating 118 will be raised to the position shown in FIG. 8. The seating 118 of this embodiment is shown in the form of a couplet of chairs.

Figure 8:
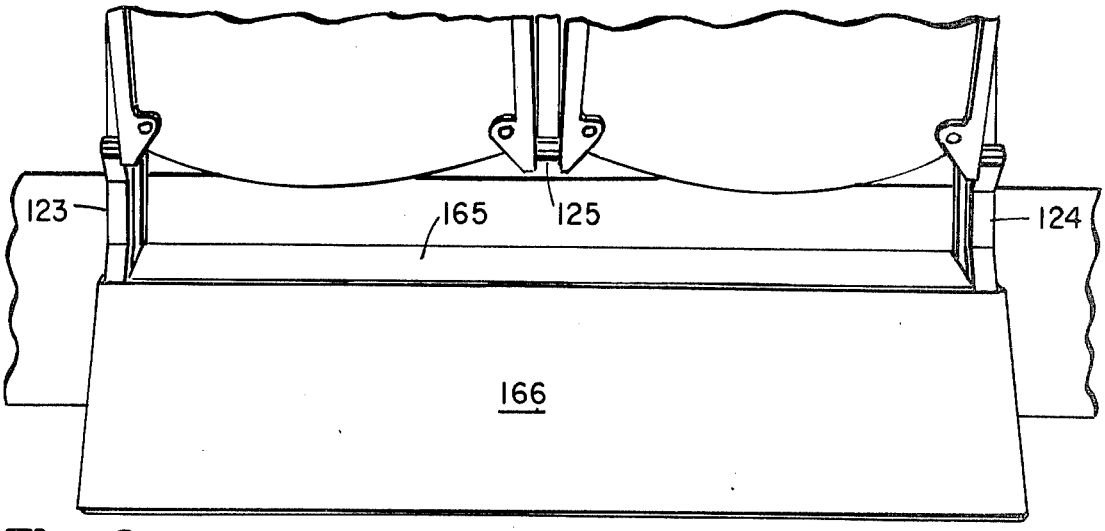
FIG. 8 is a fragmentary upper perspective view of the base of a chair couplet in an alternative embodiment incorporating the present invention in fragmentary form.

Referring now to FIG. 8, the chair couplet 118 includes left and right stanchions 123, 124. A horizontal beam 125 extends between the stanchions and, together with the stanchions, provides a frame for mounting the chair seats and backs.

Figure 9:
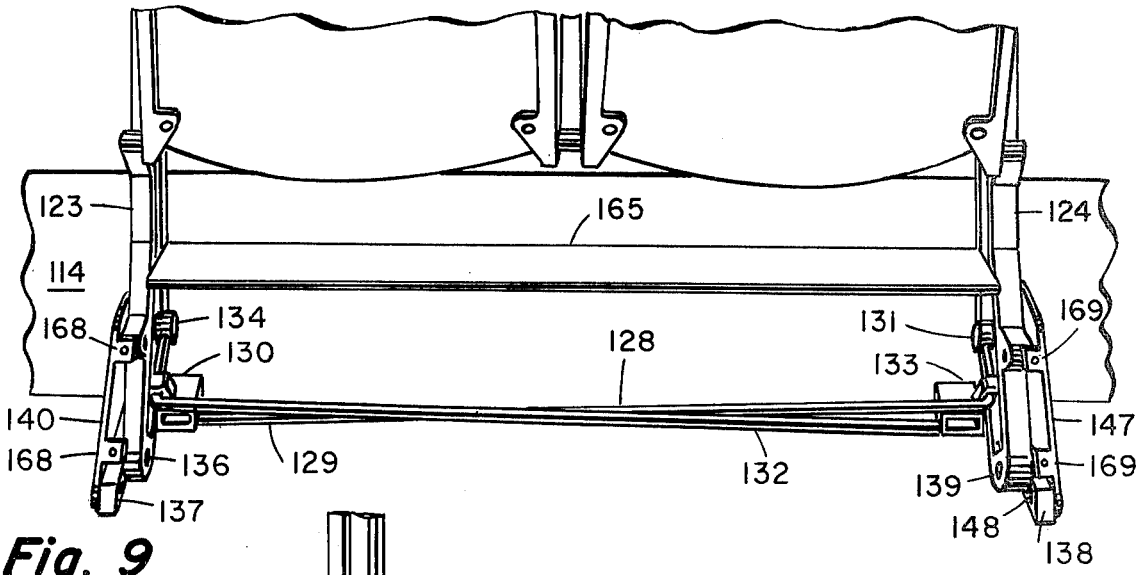
FIG. 9 is a view similar to FIG. 8 with the cover plate removed.
Figure 10:
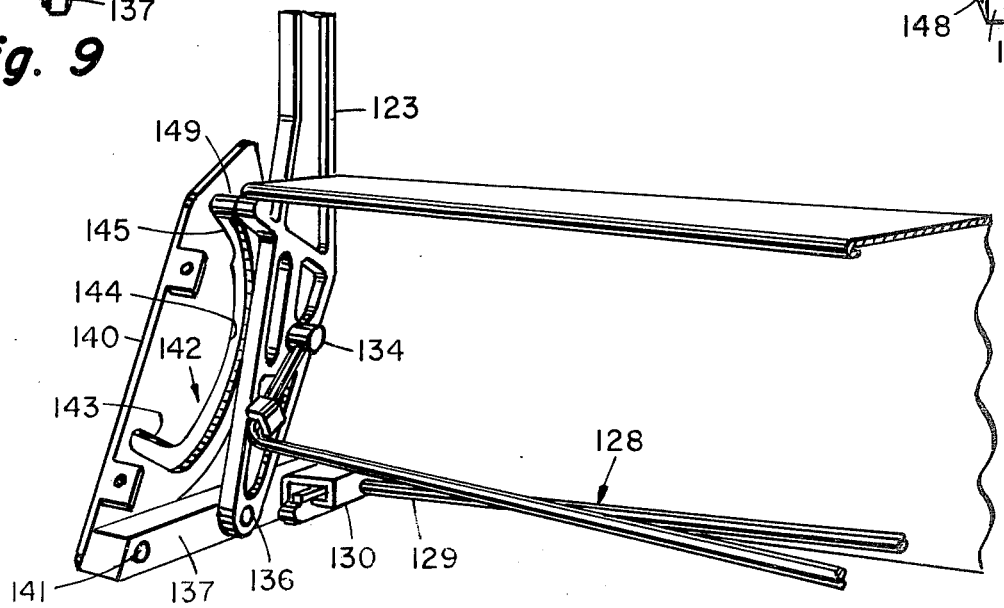
FIG. 10 is a close up perspective view of the bottom of the left stanchion of the chair couplet of FIG. 8.

As best seen in FIGS. 9 and 10, a torsion rod assembly generally designated 128 forms the energy storage means for counterbalancing the weight of the chairs and stanchions. It is preferred that an additional force in the range of five pounds per chair be used to fully raise them, which force, of course, is provided by the power mechanism which opens the system.

The torsion rod assembly of this embodiment includes a first torsion rod 129 mounted to the deck 112 at 130, and secured to the stanchion 124 at 131. The assembly includes a second torsion rod 132 mounted to the deck 112 at 133 and to the stanchion 123 at 134. When the stanchions 123, 124 are lowered, the rods 129, 132 are twisted to store the energy for counterbalancing the weight of the chairs, as described above.

The lower end of the stanchion 123 is pivotally mounted at 136 to a base member 137 which is mounted to the deck 112. Similarly, the lower end of the stanchion 124 is pivotally mounted at 139 to a base member 138. The base members 137, 138 extend rearwardly and may also be mounted to the riser 114 for additional support, if desired.

A locking member in the form of a leg or bracket 140 (see FIG. 10) is pivotally mounted at 141 to the forward portion of the base member 137; and it defines a generally C-shaped slot 142 including a lower forwardly projecting portion 143, a curved rear portion 144, and an upper forwardly projecting portion 145. A similar locking leg or brace 147 is associated with the right stanchion 124, being pivotally connected at 148 to the right side base member 140, seen in FIG. 9. A roller 149 rotatably mounted to the forward portion of the left stanchion 123 is received in and rides along the slot 142.

Figure 13:
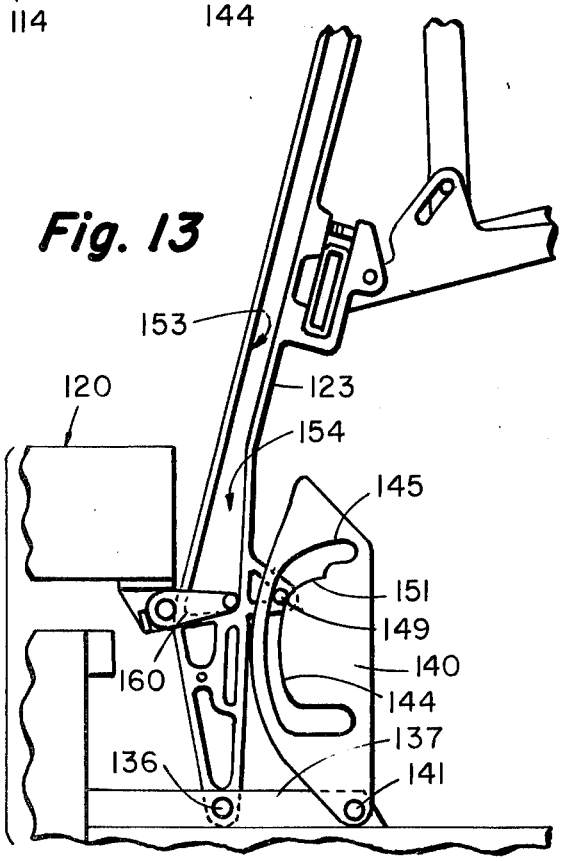
Figure 14:
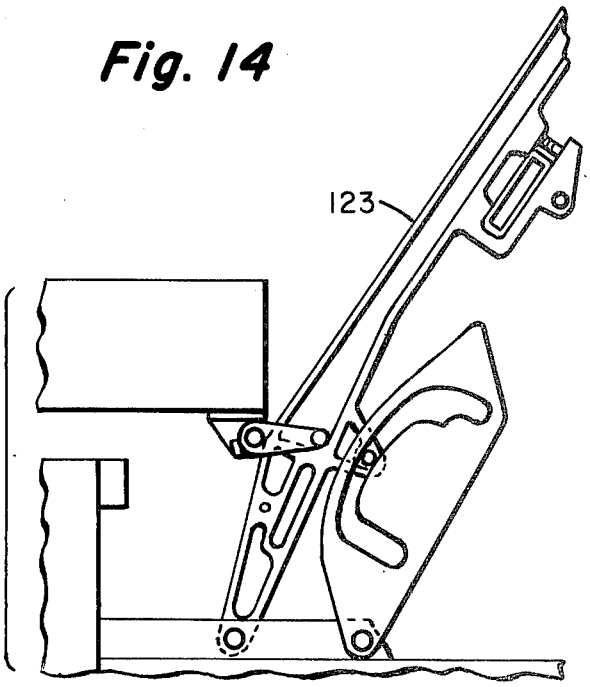

Referring now to FIGS. 11–14, and particularly to FIGS. 13 and 14, the upper slot portion 145 is widened at 151, the purpose of which will be described presently.

The stanchion 123 of this embodiment includes an elongated slot 153 which extends substantially the entire length of the stanchion, and includes a widened lower portion 154. The slot 153 has a rear guide surface 156 and a forward guide surface 157 (identified in FIG. 13).

The nose of the deck 120 of the next higher row is provided with a link or actuator 160 which is pivotally mounted at 161 to a bracket 162 secured to the nose of the deck 120. The link 160 is provided at its distal end with a cam or roller actuator 163 which rides in the slot 153 of the stanchion 123. A similar link actuator is provided for a corresponding slot on the right side of stanchion 124.

Figure 11:
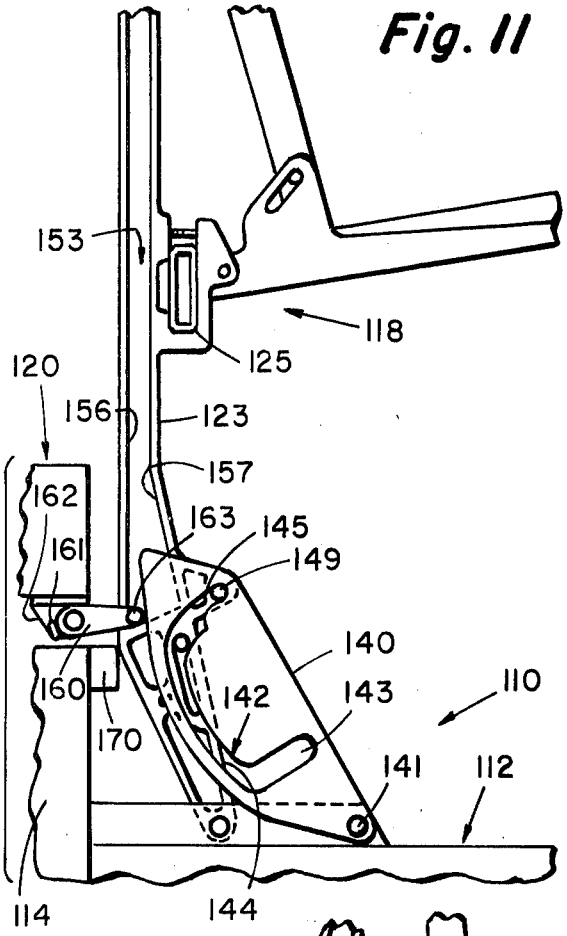
FIGS. 11–14 are fragmentary right side views of the embodiment of FIG. 8 illustrating the initial folding sequence.
Figure 12:
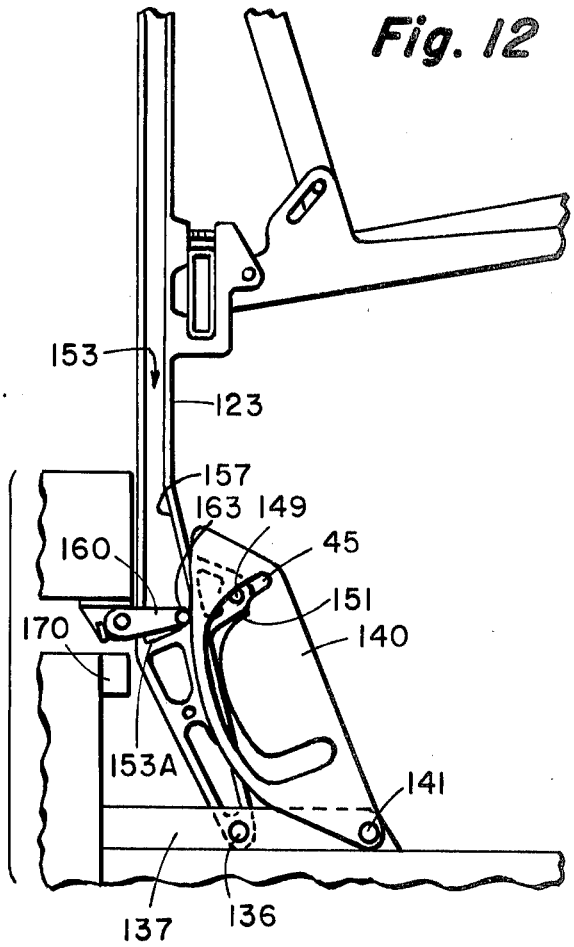

Referring back to FIGS. 8 and 9, a top cover plate 165 is mounted to the inner sides of the stanchions 123, 124; and an inclined cover plate 166 is mounted to the forward edges of the brackets 140, 147 by means of tabs 168, 169 respectively. The cover plate 166 is removed in FIGS. 9 and 10. Referring now to FIG. 11, a stop member 170 is secured to the top of the riser 114 of the lower row and serves as a limit for upright rotation of the stanchions 123, 124 to the position shown in FIG. 11. In this fully raised position, the actuator link 160 has urged the stanchion 123 to the upright position assisted by torsion rod assembly 128 through engagement of the roller actuator 163 against the rear edge 156 of the slot 153. During opening, the roller 163 engages the end surface 153A (FIG. 12) of slot 153 and is forced against the rear of the slot. When the stanchion is fully raised, the roller 149 travels in the slot 142 so that the locking leg 140 is also fully rotated counterclockwise (as seen in FIG. 11) until the roller member 149 engages the end of the upper forwardly extending portion 145 of the slot 142. This limits rotation of the locking leg 140, and it will be observed that the width of the slot portion 145 is just large enough to accommodate the roller 149. Thus, when the bracket 140 is in this position, the stanchion 123 is locked in the raised position and cannot be rotated either rearwardly (by virtue of the stop 170) or forwardly by virtue of the locking leg 140.

When it is desired to retract the seating system for storage, normally the lower row is retracted first. When the lower row 110 is retracted, the roller 163 of the actuator link 160 engages the rear surface of the locking leg 140 and urges it in clockwise rotation, as can be seen by comparing FIGS. 11 and 12. When the locking leg 140 has rotated forwardly enough such that the roller 149 on the stanchion 123 has cleared the narrowed portion of the slot portion 145, and is adjacent the widened portion 151, the stanchion is unlocked and may be rotated to a closed position. This occurs when the roller 163 on the actuator link 160 engages the forward edge 157 of the slot 153 (or when the nose of the upper row engages the back of the stanchion 123).

As the lower row is further retracted, the locking leg 140 pivots clockwise about its pivotal connection 141, and the stanchion 123 pivots clockwise or forwardly about its pivotal connection 136 to the base member 137, as seen in FIG. 13. At this time, the actuator link 160 continues to urge the stanchion 123 forwardly, and the roller 149 travels in the curved portion 144 of the slot 142 of the locking leg 140. Still further forward rotation of the stanchion 123 is illustrated in FIG. 14, as the lower row is even further retracted.

Figures 15, 16, 17:
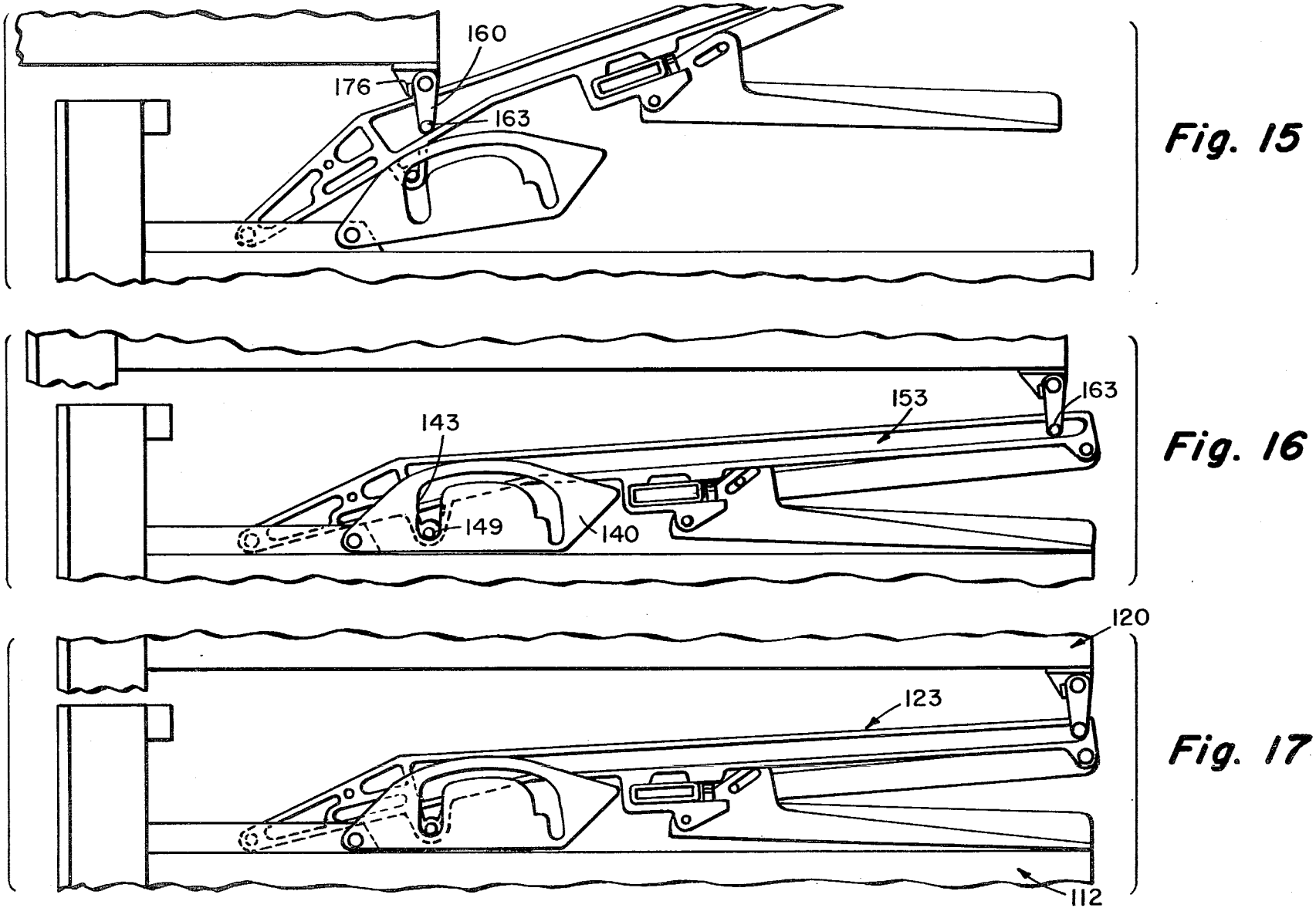
FIGS. 15–17 are fragmentary left side views illustrating the final steps in the folding sequence for the embodiment of FIG. 8.

Referring now to the sequence illustrated in FIGS. 15, 16 and 17, as the row retraction continues, the roller 163 on the actuator link continues to iurge the seating downwardly until the weight of the seating overcomes the counterbalancing force and the seating will begin to fold under its own weight. The actuator link 160 will rotate ninety degrees clockwise to the position shown in FIG. 15, until it engages a stop element 176.

With the chairs folded in the position of FIG. 16, the roller 163 further compresses the chair as it rides to the end of the slot 153, and the locking leg 140 is seen in its fully folded position, with the roller 149 in the slot portion 143. As seen in FIG. 17, when the lower row is fully retracted, the upper edge of the stanchion 123 and the seating does not extend beyond the forward surfaces of the decks 112, 120.

It will be observed that both embodiments provide a rigid frame including at least a pair of stanchions pivotally mounted to the rear of a platform and above the deck. Individual chairs including seats and backs are carried by the frame such that when the stanchions are raised responsive to the movement of a lower row to the extended position, the chairs are raised above the deck of the next higher row. This permits more comfortable individual seating because the height of each seat is not limited by the rise of the system so that it can be set for comfort, not limited by physical constraints such as the vertical row-to-row distance. Further, each occupant rests his feet on the deck of the same row which carries the seating for a feeling of greater stability.

Further, and this is important from the viewpoint of having the same basic structure available both for full automatic and semi-automatic operation, the mechanism is mounted toward the rear of each platform in such a way that the locking member is displaced to the unlocked position during the initial relative movement of rows, see FIGS. 2 and 3. This is in contradistinction to systems which mount seating to the front of the deck.

In the illustrated embodiments, fully automatic systems having wide applicability of use have been disclosed. Here, when the seating is raised, the energy storing means (torsion rods or springs) are not preloaded in the raised position, and actuators on the nose of the next higher row are used to complete the raising of the seating. If only a few rows are needed (or just the lower rows in a larger system), the rows can be made stiff enough so that the torsion rods fully raise the stanchions and even include a preload in the raised position. The system would have to overcome the preload, of course, in closing the rows in such a system. Further, one advantage of the structure of the present invention is that the same seating can also be offered in a semi-automatic version without the actuator, so that the chairs would be lifted manually to the raised position after the rows are opened. The torsion rods may be used to cushion the fall of the seating in closing in either version. It may also be offered in a manual version without actuators and without torsion rods. Here, the lock members would be unlatched by personnel who would then lower the seating manually, one group (frame) at a time.

Having thus described in detail alternative embodiments of the present invention, persons skilled in the art will be able to modify certain of the structure which has been illustrated and to substitute equivalent elements for those disclosed while continuing to practice the principle of the invention; and it is, therefore, intended that all such modifications and substitutions be covered as they are embraced within the spirit and scope of the appended claims.

I claim:

1. In a telescoping seating system having a plurality of rows, each including a platform having a horizontally extending deck, said rows being adapted for movement between a use position in which said decks are in stepped relation, and a storage position in which said decks are generally vertically aligned, the combination comprising: seating means in each row, each seating means comprising frame means including at least first and second stanchion means pivotally mounted to the rear portion of the deck for said row for movement between a raised and a lowered position, and at least one back and one seat carried by said frame means; actuator means mounted to the forward portion of an upper row for engaging the seating means mounted to the next lower row for urging said seating means to the use position when the next lower row is extended for use; and locking means responsive to the relative movement between a lower row and the next higher row for releasably locking said frame means in the use position when said lower row is extended, said locking means being responsive to the relative closing movement between said lower row and the next higher row for unlocking said frame means when a lower row is retracted for storage.

2. The apparatus of claim 1 further comprising energy storage means responsive to the lowering of said seating means for storing energy and counterbalancing at least some of the weight of said seating means in the lowered position.

3. The apparatus of claim 2 wherein said energy storage means comprises torsion rod means interconnected between the rear portion of the deck of one row and associated frame means mounted on that row.

4. The apparatus of claim 2 wherein each of said stanchion means is pivotally mounted at its lower end to said deck, and wherein said locking means comprises a leg pivotally mounted to said deck at a position forward of said pivotal mounting of said stanchion means, said locking leg means including a slot for lockingly engaging said stanchion in the raised position.

5. The apparatus of claim 4 wherein said actuator means is adapted to engage said locking leg when said lower row and the next higher row are moved to a closed position to unlock said stanchion prior to lowering the same.

6. The apparatus of claim 1 wherein each of said frames includes an upwardly extending opening receiving the actuator means of the next higher row when said stanchion is in the raised position.

7. The apparatus of claim 6 wherein said actuator for said seating means is pivotally mounted to the next higher row and depends therefrom in the storage position; said opening for receiving said actuator including a first surface for engaging said depending actuator when said lower row is extended.

8. The apparatus of claim 7 wherein said opening is further defined by a second, bearing surface to which said actuator is guided by said first surface and against which said actuator bears during final placement of said seating means in the use position.

9. The apparatus of claim 1 wherein said stanchion means are pivotally mounted to said deck of a lower row at a location above said deck and beneath a horizontal extension of the platform of the next higher row; said locking means being pivotally mounted to said stanchion means beneath its pivotal mounting to its associated deck and extending rearwardly therefrom for engaging a fixed member on said deck in locking engagement when said stanchion is fully raised, said locking means being unlocked by engagement with the next higher row when said two rows move to a closing position relative to each other.

10. The apparatus of claim 9 further comprising housing means for enclosing the pivotal mounting of the lower portion of said stanchions and for enclosing the lower portion of said locking means in the use position.

11. The apparatus of claim 10 further comprising adjustable means on said housing for bearing against said stanchion in the raised position for urging the same rearwardly to minimize horizontal play in the pivotal mountings of said stanchion to said deck and said locking member to said stanchion.

12. The apparatus of claim 1 wherein said actuator means comprises a link pivotally mounted to the forward end of a higher row and engaging frame means carried by the next lower row section for urging the same to the raised position when the lower row is extended for use.

13. In a telescoping seating system having a plurality of rows, each row including a horizontally extending deck, said rows being adapted for movement between a use position in which said decks are extended in stepped relation and a storage position in which said decks are retracted in generally vertical alignment, the combination comprising: a plurality of seating means in each row, each seating means including stanchion means pivotally mounted for movement at the rear of said deck between a raised and a lowered position, said seating means further including back means and seat means carried by said stanchion means; actuator means mounted on the forward portion of the next higher row and adapted to engage said seating means as said rows are extended relative to one another for raising said seating means to an upright use position; locking means mounted for movement between a use and a storage position for locking said seating means in the raised position when a lower row is fully extended relative to the next higher row, said locking means being constructed and arranged to be unlocked by the relative motion between said rows to permit the forward folding of said seating means as said rows are retracted for storage; and energy storage means interconnected between said row and said seating means for partially counterbalancing the weight of said seating means in the lowered position.

14. The apparatus of claim 13 further comprising adjustable means operative only in the fully raised position of said stanchions for compensating for horizontal play in the mountings of said stanchions and said locking members.

15. In a telescoping seating system having a plurality of rows, each row including a horizontally extending platform, said rows being adapted for movement between a use position in which said platforms are extended in stepped relation and a storage position in which said platforms are retracted in generally vertical alignment, the combination comprising: seating means in each row including a frame having at least first and second stanchion means pivotally mounted to the rear portion of the platform for said row for movement between a raised and a lowered position; means carried by the forward portion of the next higher row for engaging said seating means when said rows are extended relative to one another to pivot said stanchion means to a raised position; and locking means movable to an operable position to lock said stanchions in the raised position when said rows are fully opened.

16. The apparatus of claim 15 further comprising torsion spring means mounted above said platform and interconnected between said platform and said stanchion means for partially offsetting the weight of said seating means in the lowered position.

17. In a telescoping seating system having a plurality of rows, each row including a horizontally extending platform with a forward nose portion, said rows being adapted for movement between a use position in which said platforms are extended in stepped relation and a storage position in which said platforms are retracted in generally vertical alignment, the combination comprising: seating means in each row, including stanchion means pivotally mounted to the rear portion of the deck for said row for movement between a raised and a lowered position; means operative when said rows are extended relative to one another to pivot said seating means to a raised position; and a locking member movable between an operable position in which said stanchion means are locked in the raised position when said rows are fully opened and a storage position in which said stanchion means are free to pivot, said locking member extending to a position adjacent the nose portion of the platform of the next higher row when said locking member is in said operable position and adapted to be engaged by said nose portion to urge said locking member to said storage position during the initial closing movement of said rows.

18. The apparatus of claim 17 further comprising spring means interconnected between said seating means and the platform associated therewith for partially offsetting the weight of said seating means in the lowered position.

19. The apparatus of claim 17 further comprising stop means for limiting the motion of said seating means in the use position, said stop means cooperating with said locking member to secure said seating means in the use position when said rows are fully extended.

20. The apparatus of claim 17 wherein said locking member comprises an element pivotally connected to a stanchion adjacent the bottom thereof and extending rearwardly thereof in the operable position and defining a recess; said system further comprising a latch member secured to said platform and adapted for snug engagement with the recess of said locking element when said locking element is in the operable position.

21. The apparatus of claim 20 wherein said latch member comprises a splined bolt; a sleeve eccentrically mounted on said bolt; and bracket means for securing said bolt to said platform to be engaged by said recess of said locking element in the operable position, whereby snug engagement between said recess and said sleeve may be obtained by rotating said bolt about its axis.

22. The apparatus of claim 21 further comprising adjustable means operative only in the fully raised position of said stanchions for compensating for horizontal play in the mountings of said stanchions and said locking members.

23. In a telescoping seating system having a plurality of rows, each including a platform having a horizontally extending deck, said rows being adapted for movement between a use position in which said decks are in stepped relation, and a storage position in which said decks are generally vertically aligned, the combination comprising: seating means in each row, each seating means comprising frame means including at least first and second stanchion means pivotally mounted to the rear portion of the deck for said row for movement between a raised and a lowered position, and at least one back and one seat carried by said frame means such that when said stanchion means are in said raised position, said seat is above the deck of the next higher row; actuator means mounted to an upper row for engaging the seating means mounted to the next lower row for raising said seating means to the use position when the next lower row is extended for use; and locking means responsive to the relative movement between a lower row and the next higher row for releasably locking said frame means in the use position when said lower row is extended, said locking means being responsive to the relative movement between said lower and the next higher row for unlocking said frame means when a lower row is retracted for storage, whereby the height of said seats is independent of the rise of said system.

24. In a telescoping seating system having a plurality of rows, each row including a horizontally extending platform, said rows being adapted for movement between a use position in which said platforms are extended in stepped relation and a storage position in which said platforms are retracted in generally vertical alignment, the combination comprising: seating means in each row, each seating means including a plurality of stanchions each pivotally mounted to the rear portion of an associated platform for movement between a raised and a lowered position, a horizontal beam rigidly connected to said stanchions for movement therewith, a plurality of backs carried by said beam, and a plurality of seats pivotally mounted to said beam; means carried by the forward portion of the next higher row and interconnected with said seating means for engaging said seating means when said rows are extended relative to one another to pivot said seating means to a raised position; and locking means movable to an operable position to lock said stanchions in the raised position when said rows are fully opened.

25. The apparatus of claim 24 further comprising spring means mounted on said platform and interconnected between said platform and said seating means for partially offsetting the weight of said seating means in the lowered position.

26. The apparatus of claim 24 wherein locking means is disengaged in the initial relative closing motion of the next higher row to unlock said seating means.

27. In a telescoping seating system having a plurality of rows, each row including a horizontally extending deck, said rows being adapted for movement between a use position in which said decks are extended in stepped relation and a storage position in which said decks are retracted in generally vertical alignment, the combination comprising: a plurality of seating means in each row, each seating means including stanchion means, and back means and seat means carried by said stanchion means; housing means for pivotally mounting said stanchion means to the rear of the top of an associated deck whereby said seating may be moved between a use position and a storage position; latch means mounted to said housing means; locking means mounted for movement between a use and a storage position for locking said stanchion means to said latch means in the raised position and operable only when a lower row is fully extended relative to the next higher row; and adjustable means operative only when said stanchion means is fully raised for engaging the same and urging it horizontally to remove play in its pivotal mounting.

28. In a telescoping seating system having a plurality of rows, each including a platform having a horizontally extending deck, said rows being adapted for movement between a use position in which said decks are in stepped relation, and a storage position in which said decks are generally vertically aligned, the combination comprising: seating means in each row, each seating means comprising frame means including at least first and second stanchion means pivotally mounted to the rear portion of the deck for said row for movement between a raised and a lowered position, and at least one back and one seat carried by said frame means; locking means responsive to the relative movement between a lower row and the next higher row for releasably locking said frame means in the use position when said lower row is extended; and energy storage means connected to said stanchion means and responsive to the lowering of said seating means for storing energy and counterbalancing at least some of the weight of said seating means in the lowered position, and for raising said seating toward the use position when said lower row is extended.

* * * * *